US011046088B2

(12) United States Patent
Hong

(10) Patent No.: US 11,046,088 B2
(45) Date of Patent: Jun. 29, 2021

(54) DIGITAL JET PRINTING MACHINE AND A METHOD OF THE SAME

(71) Applicant: Aidiji (Fujian) Intellectual Printing Technology Co., Ltd, Fujian (CN)

(72) Inventor: Jianshu Hong, Fujian (CN)

( * ) Notice: Subject to any disclaimer, the term of this patent is extended or adjusted under 35 U.S.C. 154(b) by 205 days.

(21) Appl. No.: 16/462,960

(22) PCT Filed: Sep. 21, 2018

(86) PCT No.: PCT/CN2018/106977

§ 371 (c)(1),
(2) Date: May 22, 2019

(87) PCT Pub. No.: WO2019/205473

PCT Pub. Date: Oct. 31, 2019

(65) Prior Publication Data

US 2021/0107291 A1 Apr. 15, 2021

(30) Foreign Application Priority Data

Apr. 24, 2018 (CN) ..... 201810373155.8

(51) Int. Cl.

| | |
|---|---|
| ***B41J 11/00*** | (2006.01) |
| ***B41J 2/21*** | (2006.01) |
| ***B41J 3/407*** | (2006.01) |
| ***D06P 5/30*** | (2006.01) |

(52) U.S. Cl.
CPC ..... *B41J 2/2103* (2013.01); *B41J 2/2117* (2013.01); *B41J 3/4078* (2013.01); *B41J 11/0005* (2013.01); *D06P 5/30* (2013.01); *B41J 2202/21* (2013.01)

(58) Field of Classification Search
CPC .... B41J 2/2103; B41J 3/4078; B41J 11/0005; B41J 2202/21; B41J 2/2117; D06P 5/30
See application file for complete search history.

(56) References Cited

U.S. PATENT DOCUMENTS

2017/0341416 A1* 11/2017 Yang ..... B41J 2/21
2018/0147830 A1* 5/2018 Driessen ..... B41J 2/0057

* cited by examiner

*Primary Examiner* — Yaovi M Ameh
(74) *Attorney, Agent, or Firm* — Prakash Nama; Global IP Services, PLLC

(57) ABSTRACT

A digital jet printing machine, having a transportation device that transports an article to be printed, at least one first digital jet printing mechanism that sprays white ink, and a second digital jet printing mechanism that sprays color ink; a smoothening mechanism that smoothens the article is provided between the at least one first digital jet printing mechanism and the second digital jet printing mechanism. Compared with conventional dry spray technique that sprays white ink and color ink directly, the digital jet printing machine produces color print on a white ink layer to achieve smoothness and better clarity of the printed patterns.

4 Claims, 5 Drawing Sheets

DIGITAL JET PRINTING MACHINE AND A METHOD OF THE SAME

BACKGROUND OF THE INVENTION

The present invention relates to the technical field of digital printing, and more specifically relates to a digital jet printing machine and a method of the same.

Digital printing is applied on for example surface materials or T-shirts. Digital printing has the advantages of quick responses and high efficiency. A conventional digital printing machine drives a nozzle to move reciprocally via a driving mechanism to spray ink in order to achieve digital printing. In case of color printing, a base layer is first formed on the article subject to printing by using white pastes, and then colors are sprayed on the base layer to form a surface layer, thereby achieving color digital printing. To increase product quality, the Applicant has disclosed "a digital printing machine for dual printing of white ink and color ink having an oval shape and multiple platforms" in CN206186545U, which comprises a plurality of digital printing bodies and a transportation device for transporting the articles to be printed; each of the digital printing bodies comprises a frame, a nozzle mechanism movably installed on the frame, a driving mechanism that drives the nozzle mechanism to move reciprocally, and an ink supply mechanism; an output end of the ink supply mechanism is connected to an input end of the nozzle mechanism; the plurality of digital printing bodies at least comprise a first digital printing body for spraying white ink and a second digital printing body for spraying color ink; the transportation device comprises a continuous transportation belt of an oval shape, and a plurality of platforms installed on the continuous transportation belt for carrying the articles to be printed; the platforms are positioned corresponding below the nozzle mechanism; the first digital printing body and the second digital printing body is configured sequentially along a transportation direction of the continuous transportation belt.

Although the digital printing machine disclosed in the above Chinese patent can increase production efficiency, printing on hairy or longer fabric by this digital printing machine results in unclear and non-smooth printed patterns due to the hairy nature of the fabric that causes the base layer not having the required smoothness. Therefore, the printed garments or cloths are considered defective products.

In view of the above disadvantages of the prior art, the present invention is conceived.

BRIEF SUMMARY OF THE INVENTION

An object of the present invention is to provide a digital jet printing machine that can increase printing quality.

A method of digital jet printing that increases printing quality is also provided by the present invention.

To fulfill the above objects, the present invention has provided the following technical solutions:

A digital jet printing machine, comprising a transportation device that transports an article to be printed, at least one first digital jet printing mechanism that sprays white ink, and a second digital jet printing mechanism that sprays color ink; a smoothening mechanism that smoothens the article to be printed is provided between the at least one first digital jet printing mechanism and the second digital jet printing mechanism.

Preferably, the smoothening mechanism comprises a press board and a press board driving mechanism that drives the press board to move up and down.

Preferably, the smoothening mechanism comprises a rotational shaft, a roller rotatably provided on the rotational shaft, and a roller driving mechanism that drives the roller to roll on the article to be printed.

Preferably, the at least one first digital jet printing mechanism comprises two first digital jet printing mechanisms; the smoothening mechanism 30 provided between the two first digital jet printing mechanisms.

Preferably, the transportation device comprises at least one platform that carries the article to be printed, and a transportation mechanism that drives the platform to move.

Preferably, the digital jet printing machine also comprises a liquid spraying device that sprays pretreatment liquid; the liquid spraying device, the at least one first digital jet printing mechanism and the second digital jet printing mechanism are arranged sequentially along a transportation direction of the transportation device.

Preferably, the digital jet printing machine also comprises a first drying device between the liquid spraying device and the at least one first digital jet printing mechanism.

Preferably, the digital jet printing machine also comprises a second drying device; the at least one first digital jet printing mechanism, the second digital jet printing mechanism and the second drying device are arranged sequentially along the transportation direction of the transportation device.

Preferably, the at least one first digital jet printing mechanism comprises a first frame, a first nozzle mechanism movably installed on the first frame, a first driving mechanism that drives the first nozzle mechanism to move reciprocally and a first ink supply mechanism; an output end of the first ink supply mechanism is connected with an input end of the first nozzle mechanism; the second digital jet printing mechanism comprises a second frame, a second nozzle mechanism movably installed on the second frame, a second driving mechanism that drives the second nozzle mechanism to move reciprocally, and a second ink supply mechanism; an output end of the second ink supply mechanism is connected with an input end of the second nozzle mechanism.

A method of digital jet printing, comprising the following steps:

A: spraying or coating pretreatment liquid on an article to be printed, and then drying or ironing the article to be printed to remove excessive water;

B: spraying white ink on the article to be printed to form a base layer by using a digital jet printing mechanism that sprays white ink.

C: smoothening the base layer;

D: spraying white ink on a surface of the base layer to form a fundamental layer by using the digital jet printing mechanism that sprays white ink;

E: spraying color ink on a surface of the fundamental layer to form a surface layer by using a digital jet printing mechanism that sprays color ink.

A method of digital jet printing, comprising the following steps:

A: spraying or coating pretreatment liquid on an article to be printed, and then drying or ironing the article to be printed to remove excessive water;

B: spraying white ink on the article to be printed to form a base layer by using a digital jet printing mechanism that sprays white ink;

C: smoothening the base layer;

D: spraying color ink on a surface of the base layer to form a surface layer by using a digital jet printing mechanism that sprays color ink, and then drying the article to be printed.

Preferably, the digital jet printing mechanism comprises a frame, a nozzle mechanism movably installed on the frame, a driving mechanism that drives the nozzle mechanism to move reciprocally, and an ink supply mechanism. An output end of the ink supply mechanism is connected with an input end of the nozzle mechanism. The article to be printed is disposed on the transportation device and is sprayed with ink when it is transported to a position below the nozzle mechanism.

The present invention provides a smoothening mechanism to smoothen the article to be printed between the first digital jet printing mechanism and the second digital jet printing mechanism. After white ink is sprayed, the base layer of white ink on the article is in a semi-dried condition. By means of the smoothening mechanism, the hairy fabrics that stand up on the article can be smoothened together with the base layer of white ink. By means of the adhesive property of white ink, the hairy fabrics can be adhered onto the article and will not stand up. Next, white ink is further sprayed on the article to further cover the hairy fabrics before spraying color ink. Compared with direct spraying of white ink and color ink, the present invention can smoothen the hairy fabrics more satisfactorily, and provide a flat layer of white ink. Therefore, when color ink is sprayed on the white ink, the printed patterns are smooth and clear. Furthermore, white ink will somehow infiltrate into the article due to the smoothening operation by the smoothening mechanism, and this increase the resistance of the printed pattern layer against washing.

REFERENCE SIGNS IN THE FIGURES

10—first digital jet printing mechanism; 20—second digital jet printing mechanism; 30—smoothening mechanism; 40—transportation device; 50—article to be printed; 60—first drying device; 70—liquid spraying device; 80—second drying device.

DETAILED DESCRIPTION OF THE INVENTION

The present invention is further described in detail below with reference to the accompanying drawings.

Figure 1:
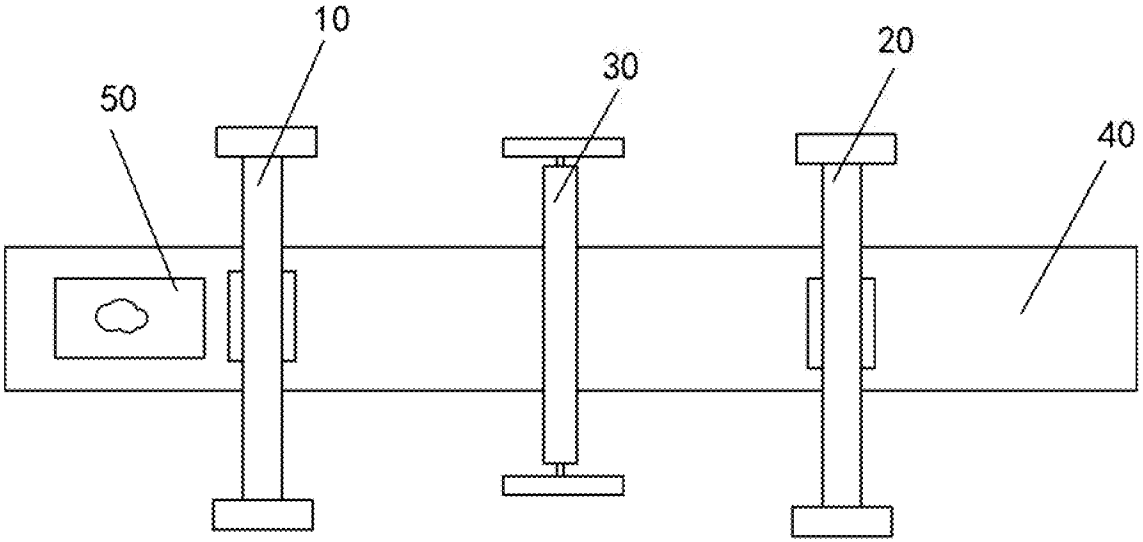
FIG. 1 is a schematic structural view showing a first embodiment of the present invention.
Figure 2:
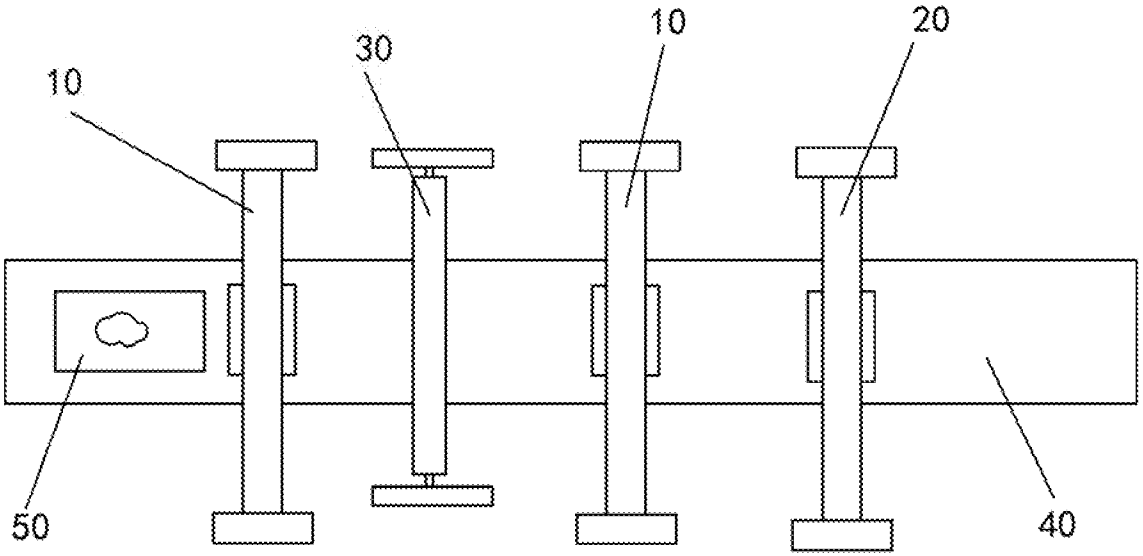
FIG. 2 is a schematic structural view showing a second embodiment of the present invention.
Figure 3:
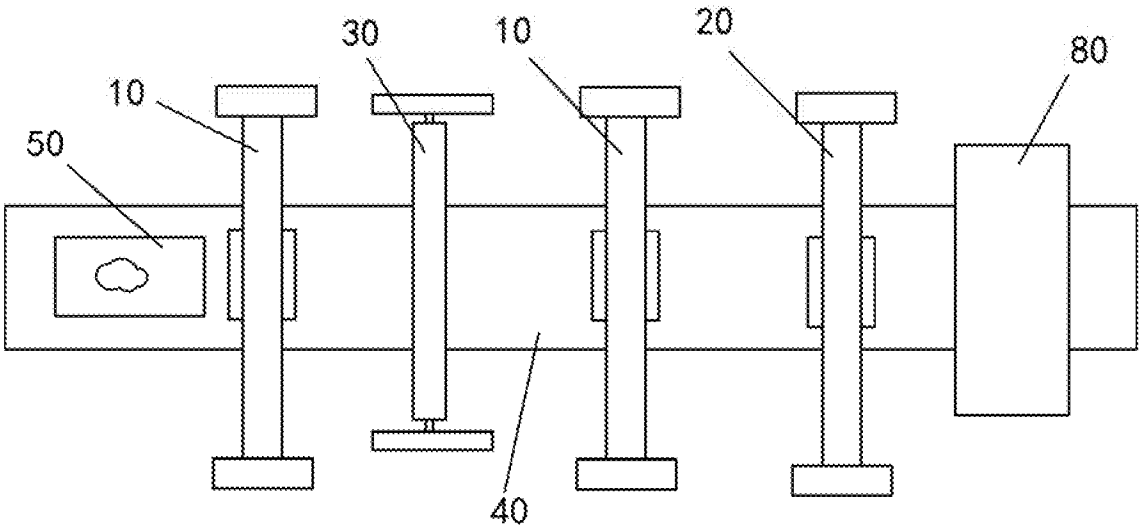
FIG. 3 is a schematic structural view showing a third embodiment of the present invention.
Figure 4:
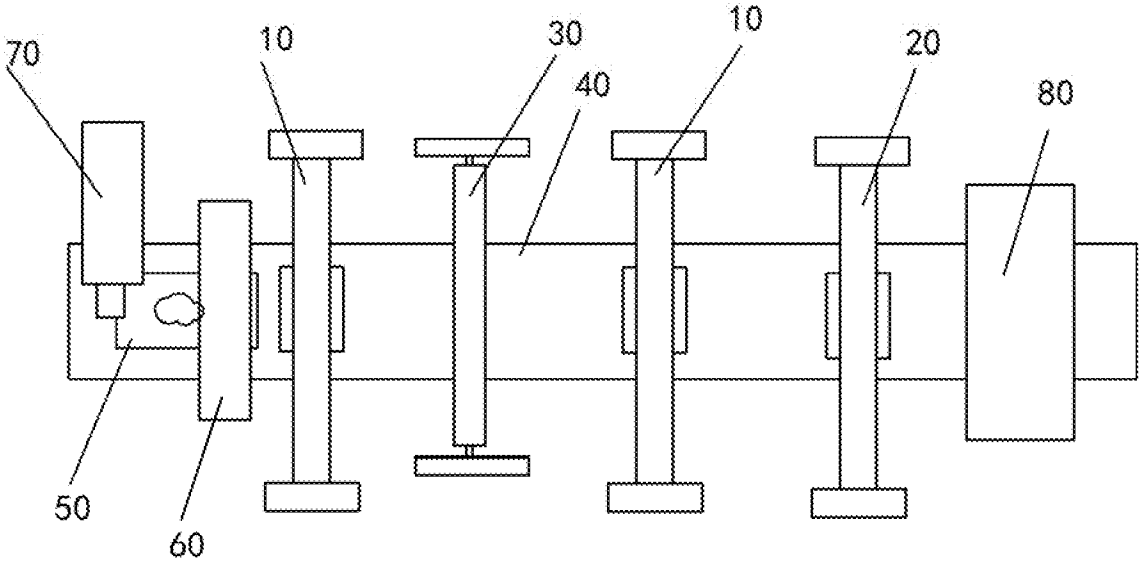
FIG. 4 is a schematic structural view showing a fourth embodiment of the present invention.
Figure 5:
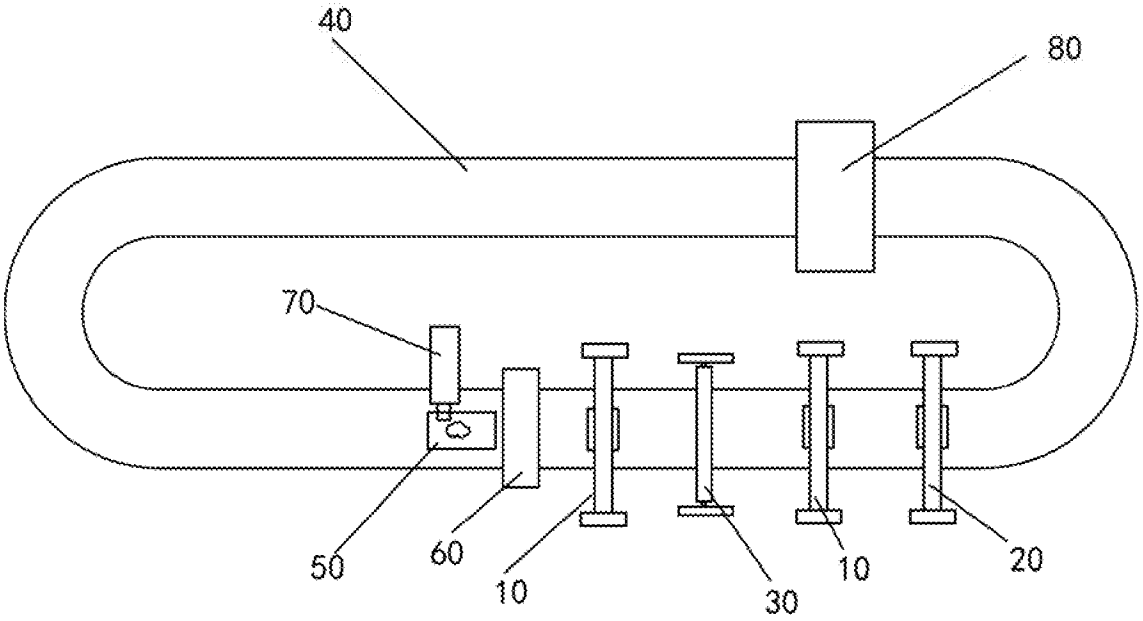
FIG. 5 is a schematic structural view showing a fifth embodiment of the present invention.

With reference to FIGS. 1-5, a digital jet printing machine is provided, comprising a transportation device 40 that transport the article to be printed, a first digital jet printing mechanism that prints with white ink, and a second digital jet printing mechanism that prints with color ink; a smoothening mechanism 30 that smoothens the article to be printed is provided between the first digital jet printing mechanism 10 and the second digital jet printing mechanism 20; the transportation device 40 can be a linear transportation belt, or an oval shaped continuous transportation belt, or a track type transportation belt as shown in FIG. 5.

Preferably, the smoothening mechanism 30 comprises a press board and a press board driving mechanism that drives the press board to move up and down; the press board is disposed above the transportation device 40; when the article to be printed 50 is transported to a position below the press board, the press board is driven by the press board driving mechanism to move downward so as to smoothen the article to be printed 50. Preferably, a Teflon coating is provided on a lower surface of the press board to prevent the press board from ink adhesion. A heating mechanism is also provided on the press board to heat up the press board. In accordance with the properties of the article to be printed and the properties of the while ink layer, heating is optional during smoothening procedure.

In an alternative preferable embodiment, the smoothening mechanism 30 comprises a rotational shaft, a roller rotatably provided on the rotational shaft, and a roller driving mechanism that drives the roller to roll on the article to be printed. After white ink is printed on the article to be printed 50, the article is transported by the transportation device 40 to pass below the roller and thus being smoothened by the roller. Preferably, a surface of the roller is also coated with Teflon coating to prevent ink adhesion. A person skilled in this field of art may optionally install a heating device on the roller according to practical need.

In the present invention, the transportation device 40 can be a type that allows reciprocal movement. In other words, it is possible that after printing white ink on the article to be printed 50, the article is transported to the smoothening mechanism 30 to be smoothened, and then returns to the first digital jet printing mechanism 10 for white ink jet printing. Preferably, the transportation device 40 is a uni-directional transportation device, two first digital jet printing mechanisms 10 are provided, and the smoothening mechanism 30 is provided between the two first digital jet printing mechanisms 10. The jet volume of the two first digital jet printing mechanisms 10 is substantially the same as the jet volume of white ink in a white ink digital jet printing machine according to prior art.

Preferably, the transportation device 40 comprises at least one platform that carries the article to be printed 50, and a transportation mechanism that drives the platform to move. The transportation device 40 of the present invention can be the transportation device disclosed by "a digital printing machine for dual printing of white ink and color ink having an oval shape and multiple platforms" in CN206186545U.

Preferably, the present invention also comprises a liquid spraying device 70 that sprays pretreatment liquid. The liquid spraying device 70, the first digital jet printing mechanism 10 and the second digital jet printing mechanism 20 are arranged sequentially along the transportation direction of the transportation device 40. The liquid spraying device 70 can be for example a spray gun or other digital jet printing mechanisms. A first drying device 60 is provided between the liquid spraying device 70 and the first digital jet printing mechanism 10. The article to be printed is first sprayed with pretreatment liquid by the liquid spraying device 70, and then being dried or ironed by the first drying device 60.

Preferably, the present invention also comprises a second drying device 80. The first digital jet printing mechanism 10, the second digital jet printing mechanism 20 and the second drying device 80 are arranged sequentially along the transportation direction of the transportation device 40.

Preferably, the first digital jet printing mechanism 10 comprises a first frame, a first nozzle mechanism movably installed on the first frame, a first driving mechanism that drives the first nozzle mechanism to move reciprocally and a first ink supply mechanism. An output end of the first ink supply mechanism is connected with an input end of the first nozzle mechanism. The second digital jet printing mechanism 20 comprises a second frame, a second nozzle mechanism movably installed on the second frame, a second driving mechanism that drives the second nozzle mechanism to move reciprocally, and a second ink supply mechanism. An output end of the second ink supply mechanism is connected with an input end of the second nozzle mechanism. Such jet printing mechanism is already disclosed by "a digital printing machine for dual printing of white ink and color ink having an oval shape and multiple platforms" in CN206186545U, and will not be described again herein.

Embodiment 1

A method of digital jet printing, comprising the following steps:

A: spraying white ink on an article to be printed 50 to form a base layer by using a digital jet printing mechanism that sprays white ink; in the present invention, the digital jet printing mechanism that sprays white ink is the first digital jet printing mechanism 10; according to the technical knowledge in this field of art, the nozzle mechanism of such digital jet printing mechanism is required to move reciprocally for a number of times so as to produce a layer of white ink having a certain thickness and certain clearness. A single journey of the nozzle mechanism is usually called "one pass". A person skilled in this field of art may determine a number of journeys that the first digital printing mechanism 10 travels to spray white ink based on the properties of the article to be printed, the design of the printed patterns, and the jet volume of the nozzle etc. For instance, one to three passes may be required for the first digital jet printing mechanism to travel.

B: smoothening the base layer; after one to three passes of white ink is sprayed on the article to be printed 50, the white base layer on the article to be printed 50 is in a semi-dried condition, and hairy fabrics on the article to be printed 50 tend to adhere onto a surface of the article to be printed 50. The base layer is smoothened, for example, by ironing and press rolling using manual forces to smoothen the article sprayed with white ink, or by using the press board or press roller introduced in the above description to smoothen the article. By means of smoothening, the hairy fabrics and the white ink are pressed against the surface of the article to be printed 50, thereby obtaining a smoothened base layer.

C: spraying white ink on the surface of the base layer to form a fundamental layer by using the digital jet printing mechanism that sprays white ink, so as to completely cover the hairy fabrics on the article to be printed 50, thereby forming a flat surface. In this step, white ink can be sprayed two to four passes.

D: spraying color ink on a surface of the fundamental layer to form a surface layer by using a digital jet printing mechanism that sprays color ink.

Finally, drying the article to be printed 50 using a drying device.

Embodiment 2

A method of digital jet printing, comprising the following steps:

A: spraying or coating pretreatment liquid on the article to be printed, and then drying or ironing the article to be printed. In this field of art, digital jet printing can be performed by dry spray or wet spray. Procedures of dry spray include: spraying or coating pretreatment liquid on the article to be printed→drying or ironing→spraying white ink→spraying color ink→drying. Conventional dry spray produces a printed pattern layer with poor textile, blurry patterns and non-smooth surface. Procedures of wet spray include: spraying or coating pretreatment liquid→spraying white ink→spraying color ink→drying. Conventional wet spray uses a large amount of pretreatment liquid, and the printed pattern layer is less firm, and the procedures consumes a longer time and the working efficiency is low, however the printed patterns obtained are clearer, the surface is smoother, and the texture is better. In this step, the pretreatment liquid used is the pretreatment liquid used in conventional dry spray procedures;

next, spraying white ink on the article to be printed 50 to form a base layer by using a digital jet printing mechanism that sprays white ink. In the present embodiment, the digital jet printing mechanism that sprays white ink is the first digital jet printing mechanism 10, and the white ink is sprayed one to three passes.

B: smoothening the base layer after one to three passes of white ink is sprayed on the article to be printed 50, the white base layer on the article to be printed 50 is in a semi-dried condition, and hairy fabrics on the article to be printed 50 tend to adhere onto a surface of the article to be printed 50. The base layer is smoothened, for example, by ironing and press rolling using manual forces to smoothen the article sprayed with white ink, or by using the press board or press roller introduced in the above description to smoothen the article. By means of smoothening, the hairy fabrics and the white ink are pressed against the surface of the article to be printed 50, thereby obtaining a smoothened base layer.

C: spraying white ink on the surface of the base layer to form a fundamental layer by using the digital jet printing mechanism that sprays white ink, so as to completely cover the hairy fabrics on the article to be printed 50, thereby forming a flat surface. In this step, white ink can be sprayed two to four passes.

D: spraying color ink on a surface of the fundamental layer to form a surface layer by using a digital jet printing mechanism that sprays color ink.

Finally, drying the article to be printed 50 using a drying device.

The present embodiment of the present invention uses dry spray technique, but the clarity, surface smoothness and texture of the printed pattern layer are far more superior than the printed pattern layer obtained by the conventional dray spray.

Embodiment 3

A: spraying or coating pretreatment liquid on the article to be printed 50, and then drying or ironing the article to be printed;

B: spraying white ink on the article to be printed 50 to form a base layer by using a digital jet printing mechanism that sprays white ink;

C: smoothening the base layer;

D: spraying color ink on a surface of the base layer to form a surface layer by using a digital jet printing mechanism that sprays color ink, and then drying the article to be printed 50.

Embodiment 3 is different from embodiment 2 in that smoothening is performed after white ink is sprayed.

The machine and method described by the present invention is not limited to the embodiments and the figures as shown and described. For example, the smoothening procedure according to the present invention can be performed by for example ironing, board pressing, rolling, or scraping using manual forces. Obviously, the present invention is not limited to the operations described above. Any appropriate changes or modifications made by any person skilled in the art in accordance with the concept of the present invention should not be considered deviated from the scope of the present invention.

What is claimed is:

1. A digital jet printing machine, comprising a transportation device that transports an article to be printed, at least one first digital jet printing mechanism that sprays white ink, and a second digital jet printing mechanism that sprays color ink; wherein a smoothening mechanism that smoothens the article to be printed is provided between the at least one first digital jet printing mechanism and the second digital jet printing mechanism; the at least one first digital jet printing mechanism comprises two first digital jet printing mechanisms; the smoothening mechanism is provided between the two first digital jet printing mechanisms.

2. The digital jet printing machine of claim 1, wherein the digital jet printing machine also comprises a liquid spraying device that sprays pretreatment liquid; the liquid spraying device, the at least one first digital jet printing mechanism and the second digital jet printing mechanism are arranged sequentially along a transportation direction of the transportation device.

3. The digital jet printing machine of claim 2, wherein the digital jet printing machine also comprises a first drying device between the liquid spraying device and the at least one first digital jet printing mechanism.

4. A method of digital jet printing, comprising the following steps:

spraying or coating pretreatment liquid on an article to be printed, and then drying or ironing the article to be printed to remove excessive water;

spraying white ink on the article to be printed to form a base layer by using a digital jet printing mechanism that sprays white ink;

smoothening the base layer;

spraying white ink on a surface of the base layer to form a fundamental layer by using the digital jet printing mechanism that sprays white ink;

spraying color ink on a surface of the fundamental layer to form a surface layer by using a digital jet printing mechanism that sprays color ink.

* * * * *